US005987832A

United States Patent [19]

Kuntz

[11] Patent Number: 5,987,832

[45] **Date of Patent: *Nov. 23, 1999**

[54] SURFACE EXPANSION DEVICE

[75] Inventor: William Kuntz, Ellicott City, Md.

[73] Assignee: Eagle Inventors, LLC, Ellicott City, Md.

[ * ] Notice: This patent is subject to a terminal disclaimer.

[21] Appl. No.: 09/148,073

[22] Filed: Sep. 4, 1998

Related U.S. Application Data

[63] Continuation of application No. 08/740,788, Nov. 1, 1996, Pat. No. 5,802,791.

[51] Int. Cl.[6] ..... E04B 1/62

[52] U.S. Cl. ..... 52/394; 52/177; 52/526; 52/546; 52/557

[58] Field of Search ..... 52/177, 394, 526, 52/546, 557

[56] References Cited

U.S. PATENT DOCUMENTS

| | | | |
|---|---|---|---|
| 3,279,973 | 10/1966 | Arne | 52/573.1 X |
| 3,797,188 | 3/1974 | Mansfeld | 52/396.05 |
| 4,034,532 | 7/1977 | Reinwall, Jr. | 52/394 X |
| 4,616,954 | 10/1986 | Taga | 52/393 X |
| 5,537,790 | 7/1996 | Jackson | 52/393 |
| 5,802,791 | 9/1998 | Kuntz | 52/394 |

*Primary Examiner*—Christopher T. Kent
*Attorney, Agent, or Firm*—Sterne, Kessler, Goldstein & Fox, P.L.L.C.

[57] ABSTRACT

A surface expansion device that enables an area subject to vertical and/or horizontal expansion and contraction to continue to be passable with minimum disturbance to the adjacent surface areas. The device causes the entire surface subject to expansion to be elevated or elongated at a uniform rate. A series of break-off or collapsible tabs in each of several segments causes uniform movement of each of the several segments.

11 Claims, 5 Drawing Sheets

SURFACE EXPANSION DEVICE

This application is a continuation of U.S. patent application Ser. No. 08/740,788, filed Nov. 1, 1996, now U.S. Pat. No. 5,802,791.

FIELD OF THE INVENTION

This invention relates generally to a surface expansion device, and more particularly to a device that enables surface areas prone to expansion and/or contraction to expand and contract at a uniform rate, with minimal disturbance to adjacent surface areas. The device finds particular utility in publicly-traversed areas such as sidewalks, where the emergence of tree roots, thermal changes, seismic disturbances, etc. cause disruption to the surface area.

BACKGROUND OF THE INVENTION

The presence of trees, particularly adjacent areas such as sidewalks, bikeways, pathways, roads, driveways and parks, is highly desirable. A well planned and maintained system of trees and other foliage contributes to a sense of community and environmental well-being. Near sidewalks and roadways, trees provide not only aesthetic pleasure, but also comforting shade. However, as these trees grow, their ever-expanding root systems disrupt and displace adjacent surface areas. For example, when roots grow above or just below a paved surface, cracks form in the paved surface and elevation frequently occurs. In addition to being an aesthetic nuisance, such fissures also pose a safety hazard. In this regard, cracks in pavement and exposed roots in grassy areas can expose landowners and municipalities to legal and financial liability.

Moreover, the constant upkeep of these areas is a drain on manpower and money. For example, untold municipal resources are diverted to repairing cracked, uneven pavement in public sidewalks. Such repair requires, at a minimum, filling in the cracks or smoothing the elevation with tar or other asphalt and, in more extreme cases, entails ripping up old pavement, laying new asphalt, and perhaps cutting down the "offending" trees and removing the roots. This does not even include the resources needed to train individuals regarding how to perform these detailed tasks.

In light of the above, the need exists for a device which will enable surface areas to expand and contract in a controlled manner, thereby minimizing any surface distortion.

It is, therefore, an object of the present invention to provide a surface expansion device which will enable surface areas to expand and contract in a controlled manner.

It is a further object of the present invention to provide a surface expansion device which enables a surface area to expand with minimum disruption to adjacent surface areas.

It is a further object of the present invention to provide a surface expansion device which enables a surface area subject to expansion to be elevated and/or elongated at a uniform rate.

It is a further object of the present invention to provide a surface expansion device which is easy to manufacture, store, transport and assemble.

It is a further object of the present invention to provide a surface expansion device which is affordable and inexpensive.

It is a further object of the present invention to provide a surface expansion device having a safe, non-slip, load-bearing surface.

It is a further object of the present invention to provide a surface expansion device which may be used for either original or replacement construction.

SUMMARY OF THE INVENTION

To achieve the foregoing and other objects, and in accordance with the purposes of the present invention, as embodied and broadly described herein, the present invention comprises a surface expansion device. The surface expansion device includes a first plate having a top surface and a bottom surface, and a second plate having a top surface and a bottom surface. A first tab and a second tab are disposed on the first plate, laterally offset from one another. Engagement means is disposed on the second plate and engages the first tab of the first plate.

The surface expansion device may further comprise traction means disposed on the top surface of the first plate. The first and second plates may each comprise a sheet of metal. The first and second tabs may comprise cut-out portions formed within the first panel. A guide tab may be aligned with said first tab on substantially the same longitudinal axis.

The surface expansion device may further comprise anchor means and/or guide means disposed on the first plate. The second plate may be disposed partially beside and below the first plate. Upon lateral movement of the first plate with respect to the second plate, the engagement means may apply increasing pressure upon the first tab. In addition, upon sufficient lateral movement of the first plate with respect to the second plate, the engagement means may engage the second tab.

The first tab may be substantially triangle, crescent, or quadrilateral shaped. The first tab may be disposed within a first row of a plurality of tabs, and the second tab may be disposed within a second row of a plurality of tabs laterally offset from the first row of tabs.

Alternatively, the surface expansion device may comprise a first plate having a top surface and a bottom surface, a second plate having a top surface and a bottom surface, a first row of tabs aligned on the first plate along substantially the same longitudinal axis, and a second row of tabs aligned on the first plate along substantially the same longitudinal axis substantially parallel to the first row of tabs. Engagement means is disposed on the second plate, wherein upon lateral movement of the first plate with respect to the second plate, the engagement means engages the first row of tabs and subsequently engages the second row of tabs. The engagement means may be longer than either of the first or second row of tabs.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE PREFERRED EMBODIMENT

Reference will be made in detail below to the preferred embodiment of the present invention illustrated in the accompanying drawings. It should be noted that similar or identical structure is identified using identical reference numbers.

Figure 1:
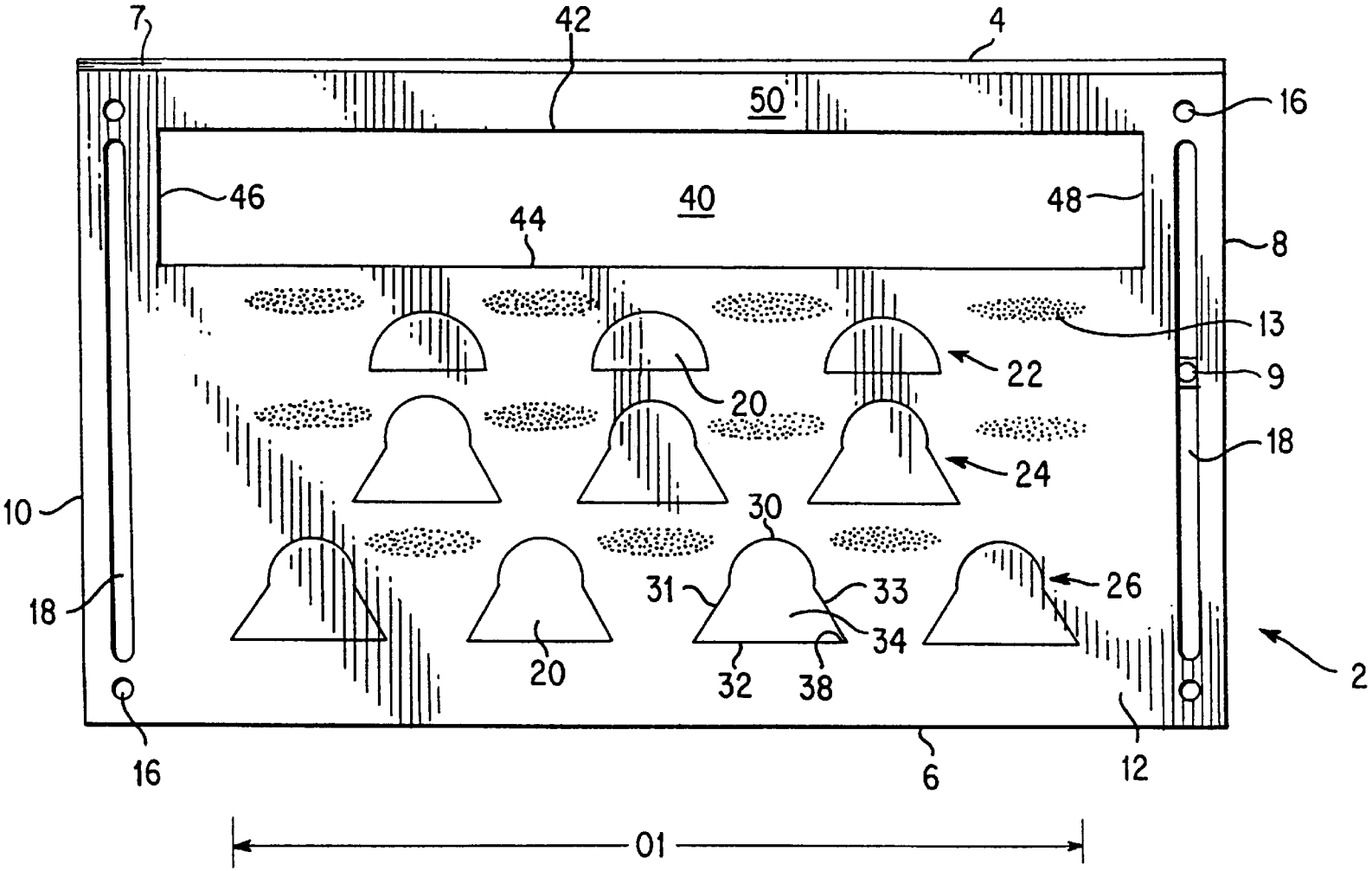
FIG. 1 is a top plan view of a plate in accordance with the surface expansion device of the present invention.

Referring now to the preferred embodiment, a surface expansion device in accordance with the present invention is shown generally at 1 in FIG 1. The surface expansion device is preferably formed of a thin, unitary sheet of rust-resistant steel. The steel should be of a gauge sufficient to bear the stresses subjected when the steel is stamped and shaped to form the desired shape.

The surface expansion device comprises a quadralinear plate 1 defined by two edges 4 and 6, and two ends 8 and 10. Plate 1 includes a top surface 12 which bears the load or impact (such as that of pedestrians, bicycles or cars) when in use. Traction means 13, such as a rubber tread surface or a non-skid coating, may be disposed on top surface 12 for ease in pedestrian and vehicular use. Bottom surface 14 is disposed beneath top surface 12, on the underside of plate 2.

When viewed from the side, it is preferred that area 5 of plate adjacent to edge 4 be curved slightly downwardly, such that a gradual upward slope or is lip 7 created which promotes ease of walking on plate 1, and adds to the structural integrity thereof.

Anchor means 16 comprising holes are formed within plate 1. Although anchor means 16 are disclosed adjacent each comer of plate 1, it is not necessary that anchor means 16 be formed within plate 1. Indeed, as discussed below, when complete freedom of translatory movement of plate 1 is desired, it is preferred that anchor means not be implemented. Moreover, when it is desired that plate 1 be anchored, only one or two anchor means 16 need be used.

A pair of guide means 18 comprising elongated slots are formed within and extend through plate 1 adjacent opposite ends 8 and 10 thereof. As discussed below, during movement of plate 1, guide means 18 (in conjunction with a bolt or similar fastener 9, help plate 1 along a substantially straight, lateral path. Although guide means 18 are shown as extending approximately half the length of ends 8 and 10 of plate 1, guide means 18 may extend substantially the entire length of ends 8 and 10 (see FIGS. 5 and 6). Moreover, although guide means 18 are shown as comprising slots formed within panel 1, numerous other structures which enable panel 1 to glide in a lateral direction may be used.

Disposed between guide means 18 are a plurality of tabs 20. Three separate rows 22, 24 and 26 of tabs 20 are shown in FIG. 1, each row comprising a series of tabs 20 aligned on the same longitudinal axis. Each tab 20 is cut within plate 1, such as by perforation. In this regard, each tab 20 includes a forward edge 30 and sides 31 and 33 separated from the body of plate 1 and a rear edge 32 wherein tab 20 remains secured to the body of plate 1. Each tab 20 further includes a top surface 34 and a bottom surface 36. Because plate 1 is preferably stamped from a thin sheet of metal, tabs 20 are somewhat flexible such that they may be bent downwardly, away from top surface 12 of plate 1. As each tab 20 is bent downwardly, away from top surface 12, it creates or reveals an aperture 28 within plate 1. Apertures 28 are preferably the same size or smaller than holes which are generally approved for grating for sidewalks. Retention means 38 are formed by the intersections of sides 31 and 33 and rear edges 32 of tabs 20.

Figure 3:
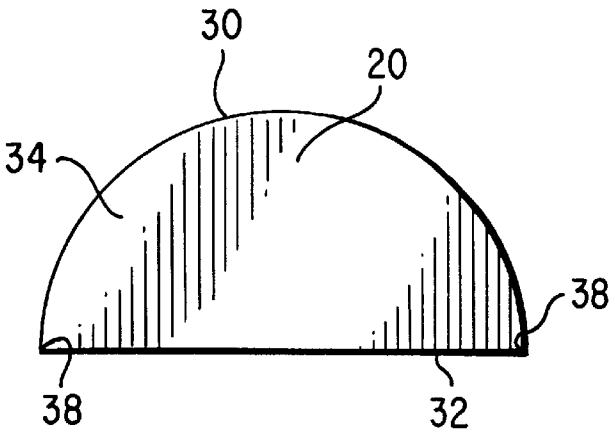
FIG. 3 is an enlarged top plan view of a second tab of a plate in accordance with the surface expansion device of the present invention.
Figure 2:
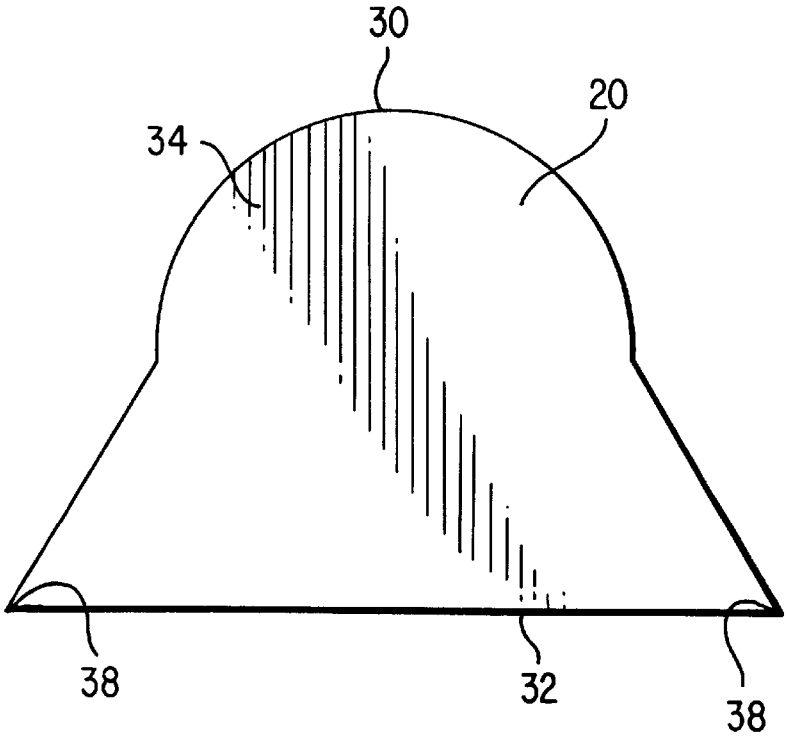
FIG. 2 is an enlarged top plan view of a tab of a plate in accordance with the surface expansion device of the present invention.

Tabs 20 may comprise any desired size and shape. For example, FIG. 1 shows some possible structures for tabs 20. Tabs 20 of first row 22 are shown as being substantially semi-circular or crescent shaped, tabs 20 of second row 24 are shown as being substantially triangular, and tabs 20 of third row 26 are shown as being somewhat triangular with a rounded head (see also FIGS. 2 and 3).

A large hole 40 extends through plate 1 laterally of tab rows 22, 24 and 26. Hole 40 comprises an elongated void or cut-out formed within plate 1, disposed between and perpendicular to guide means 18. Hole 40 is defined by edges 42 and 44 and ends 46 and 48. Edge 42 of hole 40 comprises the leading edge of engagement means 50. In this regard, engagement means 50 comprises that part of plate 1 disposed between edge 42 of hole 40 and edge 4 of plate 1. Engagement means 50 (and particularly the area adjacent edge 42) may be reinforced or otherwise made stronger than the remainder of plate 1; for example, by folding or doubling back the steel adjacent edge 42 (see FIGS. 5 and 6). Hole 40 is of a sufficient length such that it is longer than the distance d1 between the tabs 20 which are disposed at the end of the longest row 22, 24 and/or 26. Accordingly, as discussed below, engagement means 50 is capable of engaging each tab 20 in each of the respective rows 22, 24 and 26.

Figure 4:
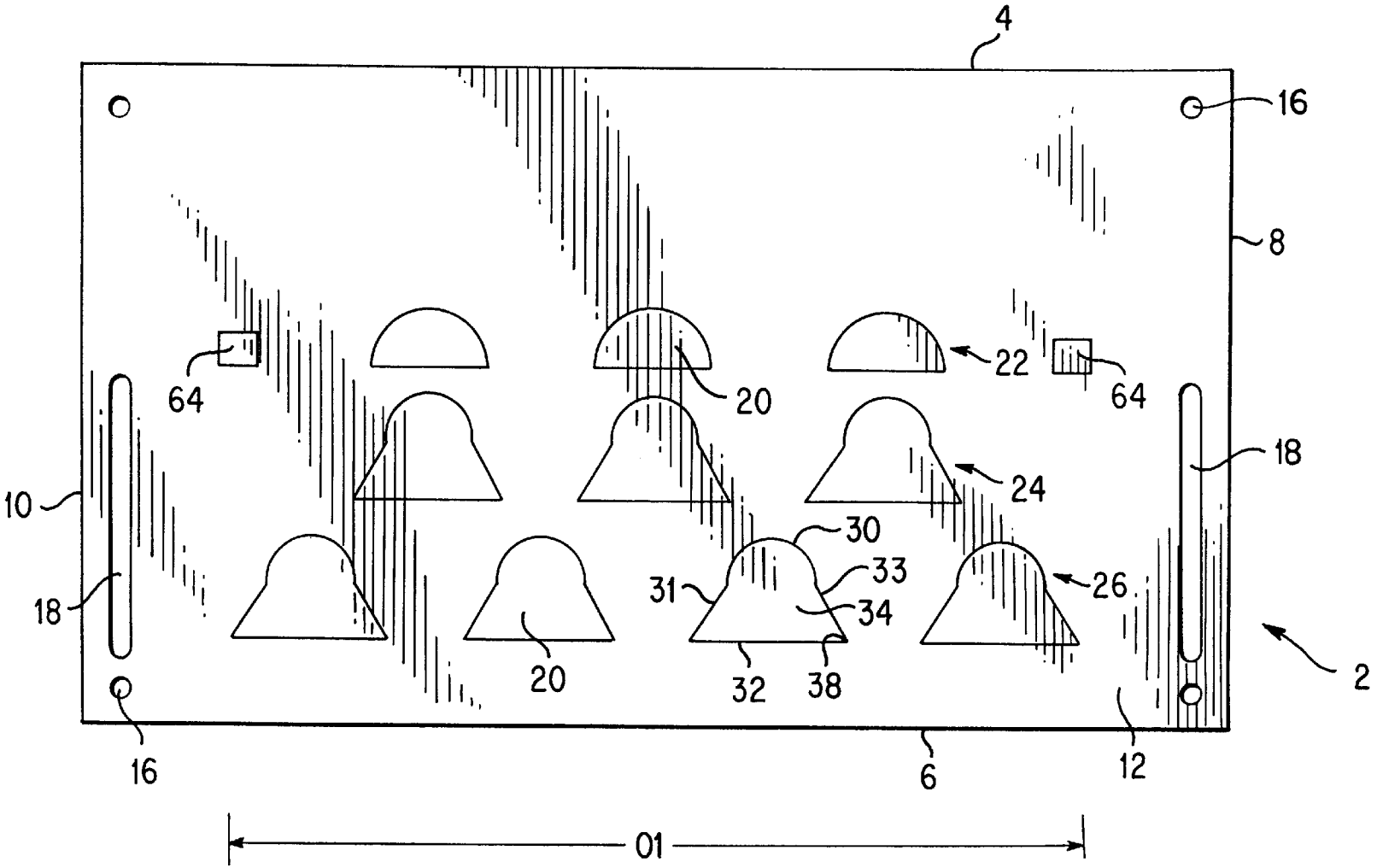
FIG. 4 is a top plan view of a second plate in accordance with the surface expansion device of the present invention.

The present invention contemplates the interaction and interlocking relationship of at least two plates similar to plate 1 discussed above. Accordingly, FIG. 4 shows a second plate 2 for use with plate 1. Similar to plate 1, plate 2 includes top surface 12 and bottom surface 14 defined by edges 4 and 6, and ends 8 and 10. Anchor means 16 comprising holes are formed within and extend through plate 2. Guide means 18 comprising elongated slots are formed within and extend through plate 2. Although guide means 18 are shown as extending substantially the entire length of ends 8 and 10, as discussed above, guide means may be shorter (or longer) in length.

Three rows 22, 24 and 26 of tabs 20 are formed within and disposed on plate 2. Substantially square-shaped guide tabs 64 are disposed adjacent leading row 22 of tabs 20. Although only shown on plate 2, guide tabs 64 may be disposed on any panel used in accordance with the present invention (and may also take any shape). As discussed below, guide tabs 64 may be used to assist the individual laying numerous plates in accordance with the present invention, by ensuring that each of the plates are aligned properly. Finally, because it is the last laid plate, it is not necessary that plate 2 include a cut-out portion such as hole 40 of plate 1. Accordingly, plate 2 also does not require engagement means 50.

In order to fully appreciate the present invention, the operation of the invention will now be described. The surface expansion device is preferably used on sidewalks, pathways, bikeways, driveways and other publicly traveled areas where vertical and/or horizontal expansion and contraction, generally due to root growth, is known or expected. If the plates are being used to create a new sidewalk, the plates would overlie a conventional "base" such as dirt, sand, gravel, etc. However, instead of leaving a significant trough or depth (for example, 4–6 inches) for pouring concrete, only a very small fraction of that need be left for laying the thin plates of the present invention.

Plate 1 is preferably placed upon the desired surface first. Plate 1 would preferably be anchored to the ground or other surface area by driving an anchor (such as a bolt) through at least one of anchor means 16. As discussed in more detail below, several other plates similar in construction to plate 1 would then be placed in a complementary, substantially flush relationship with first laid plate 1. These "intermediate" plates would preferably not be anchored.

Figure 5:
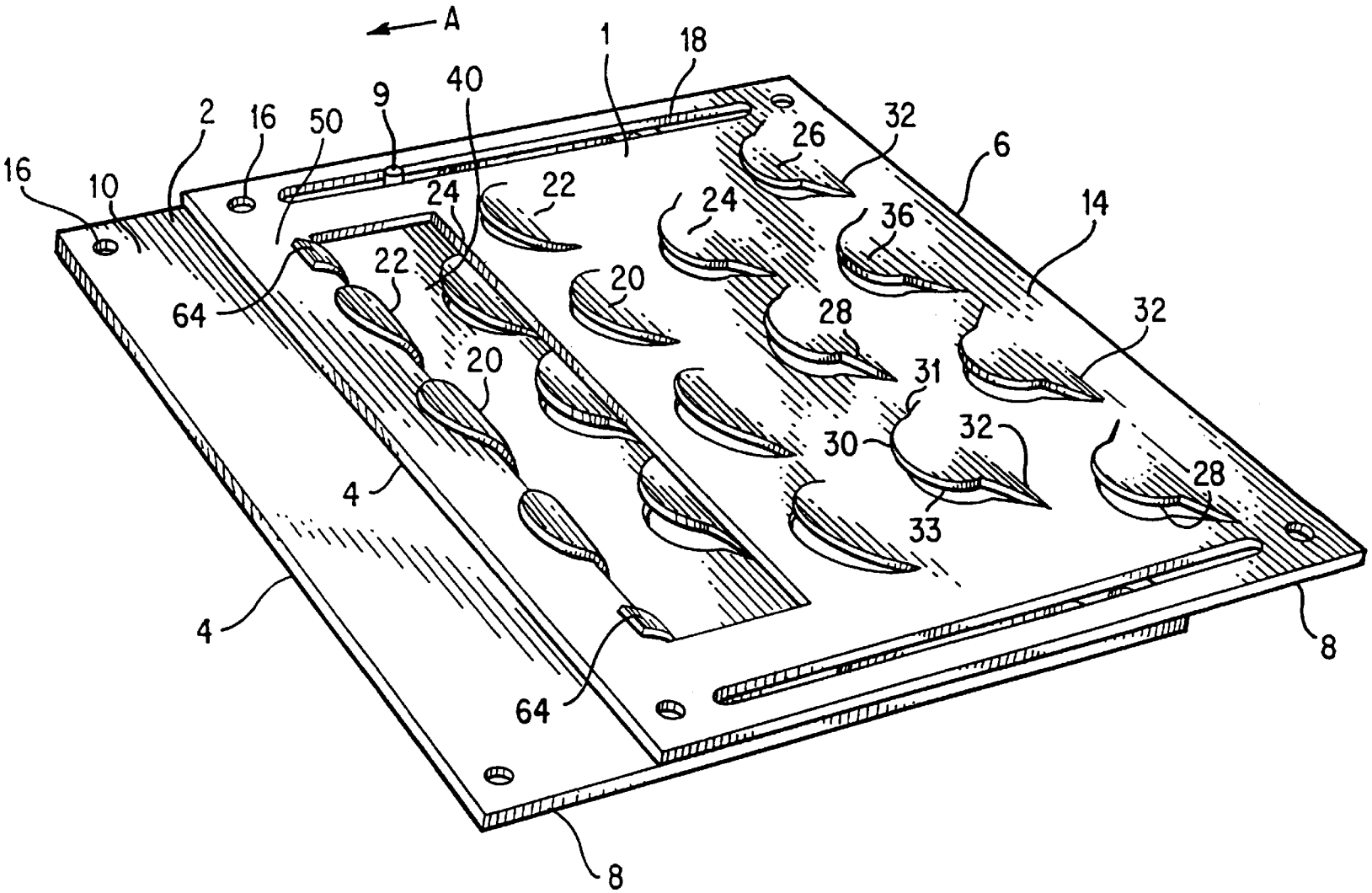
FIG. 5 is a bottom perspective view of the interlocked plates of FIGS. 1 and 4 in accordance with the surface expansion device of the present invention.

Last, plate 2 would be placed in a complementary, substantially flush relationship with the last laid plate similar to plate 1. FIG. 5 shows a bottom perspective view of the complementary, interlocking relationship of two plates, 1 and 2. Plate 1 is shown disposed partially beside and below plate 2, such that engagement means 50 of plate 1 engages leading row 22 of tabs 20 of second plate 2. In this regard, guide tabs 64 of plate 2 help ensure that plate 1 is properly aligned with plate 2. Moreover, guide means 18 of plates 1 and 2 should also be in alignment. A bolt or similar fastener 9 is preferably inserted through each guide means 18 to help keep plates 1 and 2 in the proper position, assist in guiding plates 1 and 2 in the appropriate lateral direction(s), and act as a final stop means when the bolts reach the end of guide means 18. In this regard, plates 1 and 2 are prevented from migrating to such an extent that holes 40 create open areas in the walking or other support surface. The bolts or other devices should not be too large (i.e., have too great a circumference), such that the freedom of movement of the plates is inhibited.

The construction and interrelationship of plates 1 and 2 enables the plates to buckle gradually in a vertical direction, and, more importantly, for at least the non-fixed or non-anchored plates to move laterally. Referring to FIG. 5, as an object such as a tree root grows radially and upwardly, it places upward pressure on bottom surfaces 14 of plates 1 and 2. Assuming only plate 1 is anchored, this pressure causes plate 2 to be urged outwardly in the direction of arrow A. As plate 2 is urged outwardly, engagement means 50 of plate 1 will apply increasing pressure to first row 22 of tabs 20 of plate 2. Eventually, the pressure will become so great that row 22 of tabs 20 (including guide tabs 64) can no longer restrain engagement means 50. It is preferred that tabs 20 and 64 break off from plate 2 along edges 32 when the pressure becomes too great. Alternatively, tabs 20 may be constructed so that upon sufficient pressure, they bend completely backward such that bottom surface 36 of each tab 20 comes to rest in a face-to-face, substantially flush relationship with bottom surface 14 of plate 2.

As the tree root continues to grow, plate 2 will continue to be urged outwardly in the direction of arrow A. Eventually, plate 2 will travel such that forward edges 30 of second tab row 24 of plate 2 move beneath engagement means 50 of plate 1, and engagement means 50 subsequently becomes interlocked with rear edges 32 of tabs 20 of second row 24 (and, more particularly, retention means 38 formed by the intersection of sides 31 and 33 and rear edges 32). If the tree root or other object continues to grow such that it applies sufficient pressure upon plate 2, then second tab row 24 will also bend or break off, and plate 2 can continue moving laterally such that third tab row 26 moves toward engagement means 50. Of course, if the ground surface contracts (such as due to a rotting or collapsed tree root), panel 2 is capable of moving in the direction opposite of arrow A.

Significantly, while there is frictional movement between plates 1 and 2, and tabs 20 are bending and/or breaking off along bottom surface 14 of plate 2, top surfaces 12 of plates 1 and 2 are "expanding" in a uniform manner, and no cracks are being formed therein. In this regard, plates 1 and 2 are buckling upwardly and/or moving laterally at a uniform, controlled rate. This controlled expansion results in top surfaces 12 of plates 1 and 2 combining to form a gradual, uniform slope which, if not imperceptible to the pedestrian, provides a much safer and more aesthetic walking surface.

As discussed above, it is anticipated that a plurality of plates will be used on the desired surface. For example, where a new sidewalk is to be constructed, the load-bearing surface may be formed exclusively of plates in accordance with the present invention.

Figure 6:
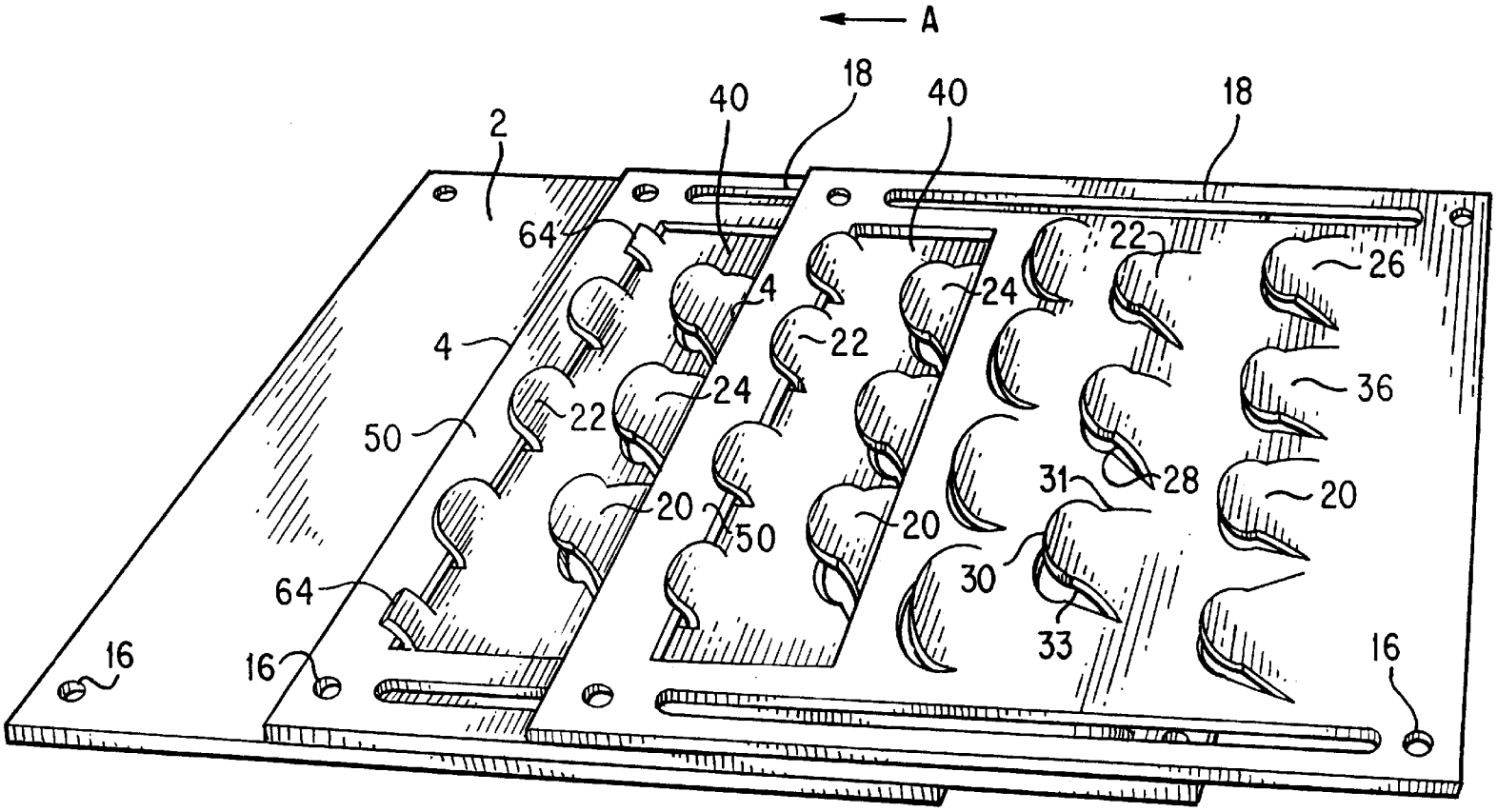
FIG. 6 is a bottom perspective view of three interlocked plates in accordance with the surface expansion device of the present invention.

By way of example, FIG. 6 shows a bottom perspective view of three plates 1, 2 and 3 of the present invention interlocked, at the time the plates are first placed upon the desired surface area. FIG. 6 is substantially similar to FIG. 5, except a third plate 3, similar in construction to plate 1, is also shown. Similar to the interrelationship between plates 1 and 2 discussed above, engagement means 50 of plate 3 engages the leading row 22 of tabs 20 of plate 1. As plate 1 is urged outwardly in the direction of arrow A, leading tab row 22 will break off or collapse such that second tab row 24, and then third tab row 26, of plate 1 continue moving laterally toward engagement means 50 of plate 3.

Obviously, a plurality of any number of plates of the present invention may be used to create or repair a load-bearing surface prone to expansion and/or contraction. When numerous plates are used, it is anticipated that the plates will interact similarly to plates 1, 2 and 3 discussed herein. Thus for example, for a very large tree root, three, four, or more plates such as described herein may be used, and may all move simultaneously in substantially the same lateral direction(s). Moreover, when a plurality of plates are implemented, it is preferred that the two plates which are disposed at the opposite ends of the series or "row" of plates be anchored, similar to plate 1 discussed above.

The foregoing description of the preferred embodiment has been presented for purposes of illustration and description. It is not intended to be exhaustive or to limit the invention to the precise form disclosed, and obviously many modifications and variations are possible in light of the above teachings. For example, although plate 2 is shown in FIGS. 5 and 6 as being disposed furthest to the left, the surface expansion device will work equally well if the series of plates are "turned around", such that plate 2 is laid furthest to the right, and the intermediate plates travel in the direction opposite of arrow A. In addition, it is not necessary that the plates be quadrilateral (i.e., square or rectangular in shape). Rather, the plates may be circular, or any other shape which is capable of providing a load-bearing surface.

Although the ends of the plates preferably include guide means which enable the plates to be guided in a lateral manner, all of the plates may instead be anchored. In addition, although the top surfaces of the plates are shown as being solid but for the various apertures formed by the tabs discussed herein, the plates may instead have numerous apertures formed therein. For example, a grid-type structure may be implemented to allow grass to go through when the surface expansion device is used in grassy areas. In this regard, the present invention is equally suited for addressing surface expansion and contraction in non-paved areas such as parks and fields.

Although the plates are each shown as including three rows of tabs, any number of tab rows may be used. Moreover, the number of tabs within each row may vary. The number of tabs may be a function of how many plates are laid, and how much expansion is desired. For example, five plates having two rows of four tabs each may be used, three plates having three "rows" of a single tab each may be used, two plates having five rows of differing numbers of tabs may be used, etc. When fewer tabs per row are used, it is preferred that the tabs be larger and/or stronger than when numerous tabs per row are used, such that the resistance to bending and/or breaking off is sufficient.

In light of the foregoing, it will be appreciated that the surface expansion device of the present invention provides numerous benefits over conventional devices (generally concrete or blacktop). For example, the present invention provides, without limitation, at least the following benefits:

expands at a uniform, controlled rate to provide a uniform slope;

forms a fixed, defined, attached edge to an existing structure;

may be either replacement or original construction;

permits moisture to reach underlying tree roots;

provides a non-slip surface for safety;

apertures are smaller than generally approved of grating for sidewalks;

external configuration may be any shape;

defined borders and points may be secured; some movement is confined to acceptable areas, degrees and direction;

installers need no special skills;

simple manufacturing process;

inexpensive materials and manufacturing process;

provides for both vertical and horizontal expansion;

readily replaceable;

the device will enhance the environment as developers, builders and government officials will be able to plant more trees and shrubs knowing that sidewalks, driveways and the like will remain passable at a minor additional cost; and the device is much thinner than conventional surface materials (i.e., concrete) requiring less disturbance to the surface area and thus enhancing growth of vegetation adjacent the surface area.

The preferred embodiment was chosen and described in order to best explain the principles of the present invention and its practical application to thereby enable others skilled in the art to best utilize the invention in various embodiments and with various modifications as are suited for the particular use contemplated. It is intended that the scope of the invention be defined by the claims appended hereto.

What is claimed is:

1. A surface expansion device, comprising:

a first plate having a top surface and a bottom surface;

a second plate having a top surface and a bottom surface;

guide means disposed on each of said first plate and second plate;

a fastener coupling said first plate with said second plate through said guide means, wherein upon lateral movement between said first plate and said second plate, said fastener slides along said guide means.

2. A surface expansion device in accordance with claim 1, wherein said fastener is a bolt.

3. A surface expansion device in accordance with claim 1, further comprising traction means on said top surface of said first and second plate.

4. A surface expansion device in accordance with claim 3, wherein said traction means is a non-skid coating.

5. A surface expansion device in accordance with claim 3, wherein said traction means is a rubber tread surface.

6. A surface expansion device in accordance with claim 1 further comprising a lip near an edge of each of said first plate and second plate, wherein said lip is a slight downward curve.

7. A surface expansion device, comprising:

a first plate having a top surface and a bottom surface;

a second plate having a top surface and a bottom surface;

guide means disposed on each of said first plate and second plate;

anchor means disposed on each of said first and second plate; and a fastener coupling said anchor means of one of said first plate and second plate with said guide means of the other of said first plate and second plate, wherein upon lateral movement between said first plate and said second plate, said fastener slides along said guide means of one of said first or second plates.

8. A surface expansion device, comprising:

a first plate having a top surface and a bottom surface;

a second plate having a top surface and a bottom surface;

guide means disposed on each of said first plate and said second plate;

anchor means disposed on each of said first and said second plate;

a lip near an edge of each of said first plate and said second plate;

traction means on said top surface of each of said first plate and said second plate; and a fastener coupling said first plate with said second plate through said guide means, wherein upon lateral movement between said first plate and said second plate, said fastener slides along said guide means.

9. A surface expansion device in accordance with claim 8, wherein said traction means is a rubber tread surface.

10. A surface expansion device in accordance with claim 8, wherein said traction means is a non-skid coating.

11. A surface expansion device in accordance with claim 8, wherein said fastener is a bolt.

* * * * *